US010123113B2

(12) United States Patent
Nesta et al.

(10) Patent No.: US 10,123,113 B2
(45) **Date of Patent: *Nov. 6, 2018**

(54) SELECTIVE AUDIO SOURCE ENHANCEMENT

(71) Applicant: SYNAPTICS INCORPORATED, San Jose, CA (US)

(72) Inventors: Francesco Nesta, Aliso Viejo, CA (US); Trausti Thormundsson, Irvine, CA (US); Willie Wu, Chino Hills, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/595,854

(22) Filed: May 15, 2017

(65) Prior Publication Data

US 2017/0251301 A1 Aug. 31, 2017

Related U.S. Application Data

(63) Continuation of application No. 14/507,662, filed on Oct. 6, 2014, now Pat. No. 9,654,894.

(Continued)

(51) Int. Cl.
*H04R 3/00* (2006.01)
*G10L 21/0208* (2013.01)

(Continued)

(52) U.S. Cl.
CPC ..... *H04R 3/005* (2013.01); *G10L 21/0208* (2013.01); *G10L 21/0272* (2013.01);

(Continued)

(58) Field of Classification Search
CPC . H04R 3/005; H04R 2430/03; G10L 21/0208; G10L 21/0272;

(Continued)

(56) References Cited

U.S. PATENT DOCUMENTS 9,654,894 B2 * 5/2017 Nesta ..... H04R 3/005

OTHER PUBLICATIONS

Nesta, Francesco et al., "Blind Source Extraction for Robust Speech Recognition in Multisource Noisy Environments", Computer Speech and Language, Aug. 23, 2012, pp. 703-725 (23 pages), vol. 27, Elsevier, London, GB.

(Continued)

*Primary Examiner* — Regina N Holder
(74) *Attorney, Agent, or Firm* — Haynes and Boone, LLP

(57) ABSTRACT

A selective audio source enhancement system includes a processor and a memory, and a pre-processing unit configured to receive audio data including a target audio signal, and to perform sub-band domain decomposition of the audio data to generate buffered outputs. In addition, the system includes a target source detection unit configured to receive the buffered outputs, and to generate a target presence probability corresponding to the target audio signal, as well as a spatial filter estimation unit configured to receive the target presence probability, and to transform frames buffered in each sub-band into a higher resolution frequency-domain. The system also includes a spectral filtering unit configured to retrieve a multichannel image of the target audio signal and noise signals associated with the target audio signal, and an audio synthesis unit configured to extract an enhanced mono signal corresponding to the target audio signal from the multichannel image.

19 Claims, 6 Drawing Sheets

Related U.S. Application Data

(60) Provisional application No. 61/898,038, filed on Oct. 31, 2013.

(51) Int. Cl.
*H04S 7/00* (2006.01)
*G10L 21/0272* (2013.01)
*G10L 21/0216* (2013.01)

(52) U.S. Cl.
CPC .... *H04S 7/305* (2013.01); *G10L 2021/02166* (2013.01); *H04R 2430/03* (2013.01); *H04S 2400/15* (2013.01); *H04S 2420/07* (2013.01)

(58) Field of Classification Search
CPC . G10L 2021/02161; G10L 2021/02166; H04S 7/305; H04S 2400/15; H04S 2420/07
See application file for complete search history.

(56) References Cited

OTHER PUBLICATIONS

Cichocki, Andrzej et al., "Blind Source Separation: New Tools for Extraction of Source Signals and Denoising", Proceedings of SPIE, Apr. 11, 2005, pp. 11-25 (15 pages), vol. 5818, SPIE, Bellingham, WA.
Saruwatari, Hiroshi et al., "Semi-Blind Speech Extraction for Robot Using Visual Information and Noise Statistics", Signal Processing and Information Technology (ISSPIT), Dec. 14, 2011, pp. 264-269 (6 pages), 2011 IEEE International Symposium On.
Pedersen, Michael Syskind et al., "A Survey of Convolutive Blind Source Separation Methods", Springer Handbook on Speech Processing and Speech Communication, Jan. 1, 2007, pp. 1-34 (34 pages).
Reindl, Klaus et al., "A Stereophonic Acoustic Signal Extraction Scheme for Noisy and Reverberant Environments", Computer Speech and Language, Jul. 31, 2012, pp. 726-745 (20 pages), vol. 27, Elsevier, London, GB.

* cited by examiner

SELECTIVE AUDIO SOURCE ENHANCEMENT

RELATED APPLICATION(S)

The present application is a continuation of U.S. patent application Ser. No. 14/507,662, filed Oct. 6, 2014, and titled "Selective Audio Source Enhancement," which claims the benefit of and priority to U.S. Provisional Patent Application Ser. No. 61/898,038, filed Oct. 31, 2013, and titled "Selective Source Pickup for Multichannel Convolutive Mixtures Based on Blind Source Signal Extraction," all of which are hereby incorporated fully by reference into the present application.

BACKGROUND ART

Speech enhancement solutions are desirable for use in audio systems to enable robust automatic speech command recognition and improved communication in noisy environments. Conventional enhancement methods can be divided into two categories depending on whether they employ a single or multiple channel recording. The first category is based on a continuous estimation of the signal-to-noise ratio, generally in the discrete time-spectral domain, and can be quite effective if the noise does not exhibit a high amount of energy variation (i.e., non-stationarity). The second category, known as beam forming, estimates a set of spatial filters aimed at enhancement of a signal coming from a predefined spatial direction. The effectiveness of beam forming methods depend on the amount of energy propagating over the steering geometrical direction and whether it is proportional on the number of available channels.

However, when the number of channels is limited and the amount of reverberation is not negligible, the conventional solutions described above typically do not provide satisfactory performance. Particularly in the case of far-field applications, i.e., when the speaker is at large distance from the microphones (e.g., more than 1 meter), for example, the amount of energy propagating over the direct path may be small compared to the reverberation.

SUMMARY

There are provided systems and methods providing selective audio source enhancement, substantially as shown in and/or described in connection with at least one of the figures, and as set forth more completely in the claims.

BRIEF DESCRIPTION OF THE DRAWINGS

The features and advantages of the present application will become more readily apparent to those ordinarily skilled in the art after reviewing the following detailed description and accompanying drawings, wherein.

DETAILED DESCRIPTION

Figure 1:
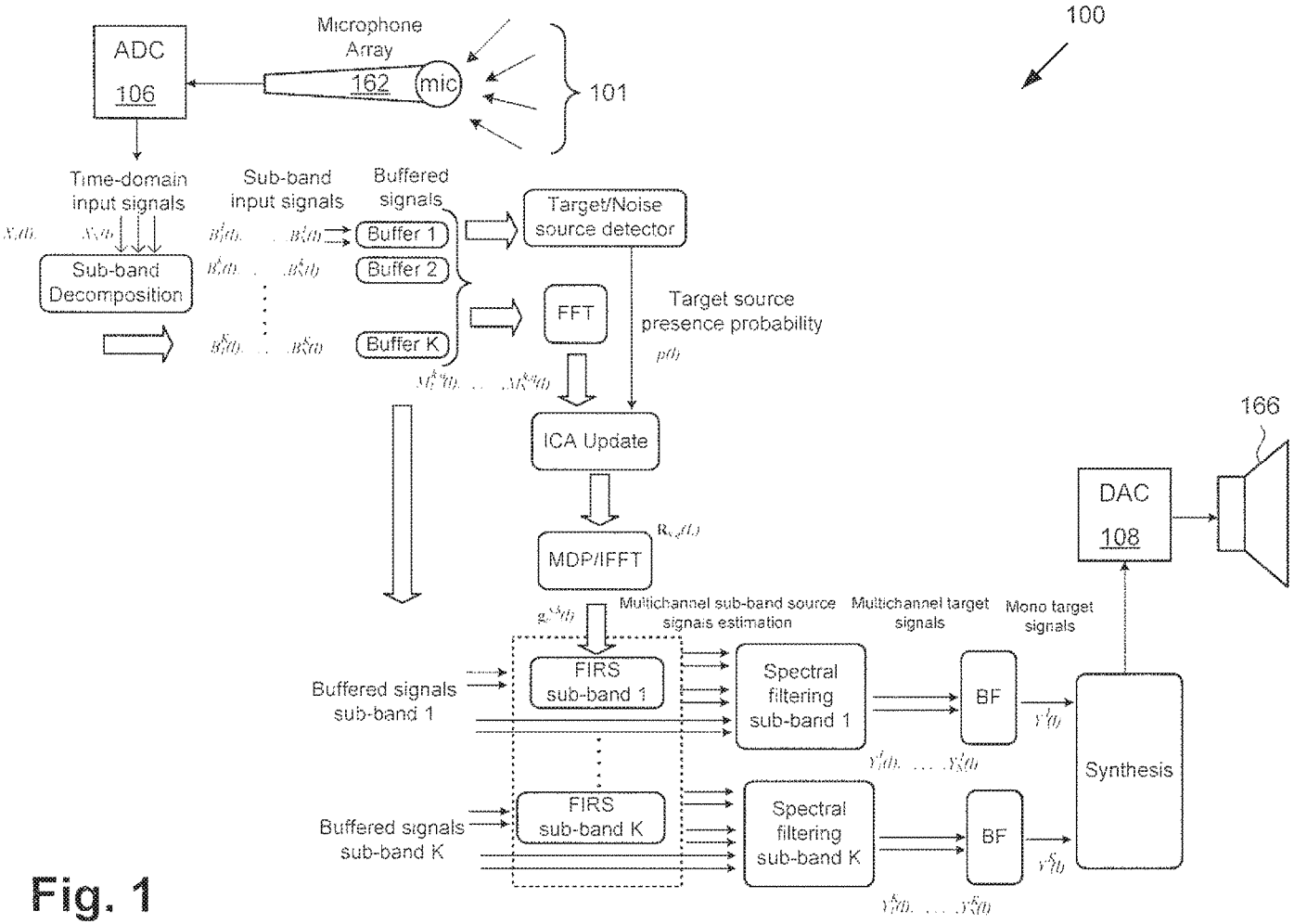
FIG. 1 is a diagram of a selective audio source enhancement or Selective Source Pickup (SSP) system architecture in accordance with an exemplary implementation of the present disclosure.

The following description contains specific information pertaining to implementations in the present disclosure. One skilled in the art will recognize that the present disclosure may be implemented in a manner different from that specifically discussed herein. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

As stated above, enhancement solutions are desirable for use in audio systems to enable robust automatic speech command recognition and improved communication in noisy environments. Conventional enhancement methods can be divided into two categories depending on whether they employ a single or multiple channel recording. The first category is based on a continuous estimation of the signal-to-noise ratio, generally in the discrete time-spectral domain, and can be quite effective if the noise does not exhibit a high amount of energy variation (i.e., non-stationarity). The second category, known as beam forming, estimates a set of spatial filters aimed at enhancement of a signal coming from a predefined spatial direction. The effectiveness of beam forming methods depend on the amount of energy propagating over the steering geometrical direction and whether it is proportional on the number of available channels.

However, when the number of channels is limited and the amount of reverberation is not negligible, the conventional solutions described above typically do not provide satisfactory performance. Particularly in the case of far-field applications, i.e., when the speaker is at large distance from the microphones (e.g., more than 1 meter), for example, the amount of energy propagating over the direct path may be small compared to the reverberation.

In one implementation, the present disclosure presents a selective audio source enhancement and extraction solution based on a methodology, referred to herein as Blind Source Separation (BSS). Multichannel BSS is able to segregate the reverberated signal contribution of each statistically independent source observed at the microphones, or other sources of audio input. One possible application of BSS is the blind source extraction (BSE) of a specific target source from the remaining noise with a limited amount of distortion when compared to traditional enhancement methods. This characteristic is preferable to allow high quality communication and accurate automatic speech recognition.

In order to meet certain performance requirements, a solution based on BSS is desired. However, the challenges that need to be addressed to provide such a solution include exploitation of the state-of-the-art BSS technology available in the research community, reduction of the computational complexity of those state-of-the-art research solutions, improvement of robustness for real time, on-line implementation, and the use of a limited amount of memory.

One BSS algorithm is a general solution of source extraction based on multistage processing, involving source detection based on direction of arrival, the weighted natural gradient, constrained independent component analysis (ICA) and spectral filtering. However, that algorithm is not optimized for limited hardware. Specifically, it is based on a hybrid combination of a batch-wise offline and on-line frequency-domain estimation. It is assumed that it is possible to buffer small segments of data, (e.g., 1-0.5) seconds, to estimate initial spatial filters for the target source in order to constrain the estimation of the on-line noise cancellation. However, this approach is not practical for hardware with limited memory and computation resources.

Another solution uses a sub-band ICA implementation that has been geometrically regularized using information on the source direction. The method first preprocesses the input signals using traditional geometrically steered beam forming and then splits the noise and target using a sub-band domain ICA algorithm. Then, the output is further post-filtered using instantaneous normalized direction of arrival (DOA) coherence. The method relies on the hypothesis that the preprocessing is accurate enough to initialize the ICA algorithm, which underlies that the direct path is strong enough against reverberation. There are also no particular concerns on resource optimization.

A detailed design description of the present solution for providing selective audio source enhancement, also defined herein as "Selective Source Pickup" or "SSP", is presented below. Although the present approach utilizes the principles of blind source extraction, which is a specialization of the BSS concept, as a starting point, the present novel solution is configured for the memory and MIPS limitations of a digital signal processor or other smaller platforms for which known computational solutions are typically impracticable. As a result, the present application discloses a robust, selective audio source enhancement solution suitable for use in speech control applications for the consumer electronics market. For example, speech control of domestic appliances such as smart TVs using speech commands, voice control applications in the automobile industry and other potential applications can be implemented using target audio source enhancement that does not degrade automated speech recognition performance, that runs on an inexpensive device, that is capable of suppressing non-stationary interfering noises when the target speaker is at far distance from the microphones, that does not introduce large spectral distortions, and that provides other advantageous features.

FIG. 1 is a diagram of an SSP system architecture in accordance with an exemplary implementation of the present disclosure. The data is buffered using a linear buffer of different size in each sub-band, in order to allow a non-uniform filter length across the sub-bands and to save memory resources. Since the filters estimated by the frequency-domain BSS adaptation are in general non-causal, a proper strategy is adopted to make them causal and guarantee that the same input/output (I/O) delay is imposed in each sub-band.

In some implementations, a selective audio source enhancement system corresponding to SSP architecture 100 can be configured to perform non-uniform spatial filter length estimation in each sub-band, based on memory resources available to the system memory. In addition, or alternatively, a selective audio source enhancement system corresponding to SSP architecture 100 can be configured to perform non-uniform spatial filter length estimation in each sub-band, based on processor resources available to the system processor.

The structure of SSP is shown by SSP system architecture 100 and can be summarized as follows. It is noted that the following description refers to voice or speech enhancement in the interests of clarity. However, the principles disclosed in the present application may be used for selective enhancement of substantially any audio source.

Referring to system architecture 100, in FIG. 1, sound 101 generated by a human voice and/or other audio source or sources is received by microphone array 162 and undergoes analog-to-digital conversion by analog-to-digital converter (ADC) 106. It is noted that although microphone array 162 is depicted using an image of a single microphone, microphone array 162 corresponds to multiple microphones for receiving sound 101. The resulting time-domain signals are then decomposed in K complex-valued (non-symmetric) sub-bands. Sub-band signals are buffered according to the filter length adopted in each sub-band. The size of the buffer depends on the order of the filters, which is adapted to the characteristic of the reverberation (i.e., long filters are used for low frequencies while short filters for high frequencies).

From the buffered data, a criterion is used to decide if the target speaker is active or not, i.e., whether the speaker or other target audio source is producing an audio output. Any suitable Voice Activity Detection (VAD) can be used with this algorithm. For example, the estimated source DOA and the a priori knowledge of the speaker location, i.e., "target beam," can be used to determine if the acoustic activity originates from a particular angular region of space. In some implementations, the target source activity may be identified based on non-audio data received from an input system external to the selective audio source enhancement system corresponding to system architecture 100.

According to the presence/absence of a target source, a supervised ICA adaptation is run in each sub-band in order to estimate spatial finite impulse response (FIR) filters. The adaptation is run at a fraction of the buffering rate to save computational power. In one implementation, non-uniform spatial filter length estimation may be based on a supervised ICA. The buffered sub-band signals are filtered with the actual FIRs to produce a linear estimation of the target and noise components.

In each sub-band, the estimated components are used to determine the spectral gains that are to be used for the final filtering, which is directly applied to the input sub-band signals. The multichannel spectral enhanced target and noise source signals are transformed in a mono signal in each sub-band, through delay-and-sum beam forming. Finally, time-domain signals are reconstructed by synthesis, may undergo digital-to-analog conversion by digital-to-analog converter (DAC) 108, and can be emitted as a selectively enhanced audio signal by speaker 166.

Figure 2:
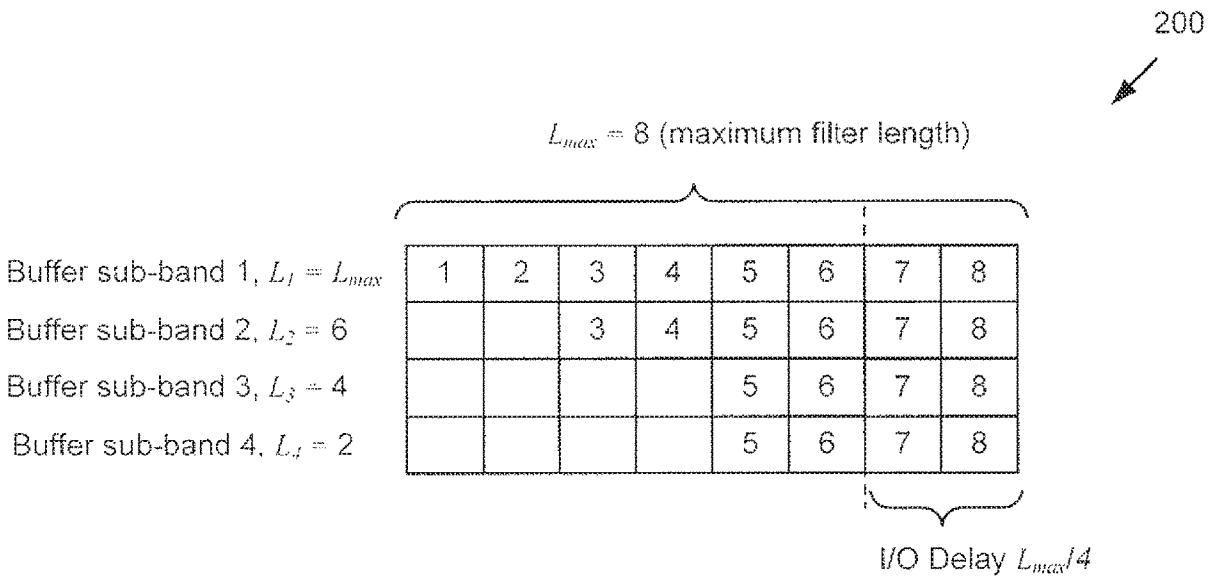
FIG. 2 is a diagram of a buffer structure in accordance with an exemplary implementation of the present disclosure.

FIG. 2 is a diagram of buffer structure 200 in accordance with an exemplary implementation of the present disclosure. Numbers indicate the progressive number of the buffered samples. $L_{max}$ indicates the maximum filter length, $L_k$, $k=1, \ldots, K$ indicates the filter length used in each sub-band. The number of the buffered samples $N_k$ used for each sub-band depends on both the length of the sub-band filters and on the I/O delay as:

if ($L_k < L_k/2+\text{delay}$)
$N_k = L_k/2+\text{delay}$
Else
$N_k = L_k$
End

Figure 3:
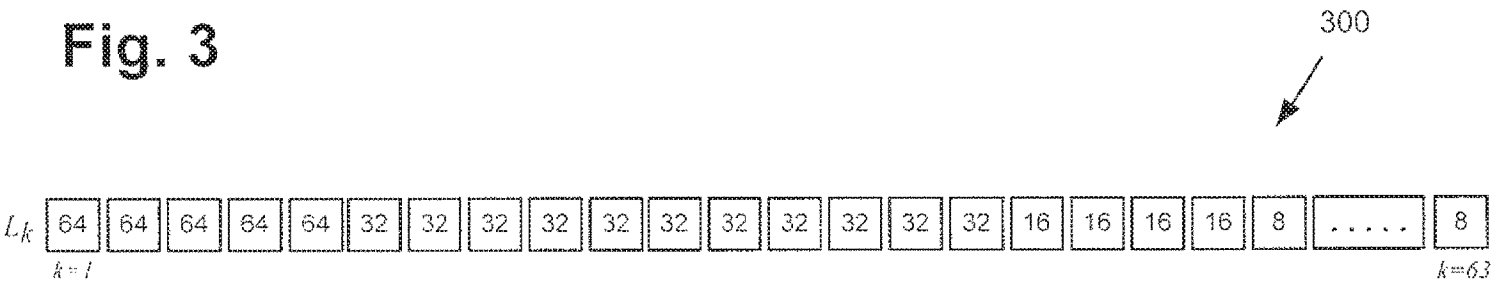
FIG. 3 is a diagram of a filter length distribution in accordance with an exemplary implementation of the present disclosure.

FIG. 3 is a diagram of a filter length distribution in accordance with an exemplary implementation of the present disclosure. Sub-band filter lengths can be optimized according to the reverberation characteristic. For example, assuming a number of 63 sub-bands, a typical dyadic non-uniform filter distribution is shown as filter length distribution 300. SSP filters are not necessarily causal. The optimal delay to exploit the full non causality in all the sub-bands is of $L_{max}/2$. The delay can be reduced to save memory but, an application dependent trade-off is necessary to keep the used memory low without significantly changing the filter performance.

The instantaneous spatial coherence can be computed for each new frame in the sub-band domain as $$SC(\theta, l) = \sum_{n=2}^{N} \sum_{k=2}^{K} \left(1 + \cos\left[\angle B_n^k(l) - \angle B_1^k(l) - 2\pi \frac{k}{K} f_s \tau_n(\theta)\right]\right) \tag{1}$$

where $B_n^k(l)$ is the l-th input frame at the sub-band k and microphone channel n, $f_s$ is the sampling frequency in the sub-band decomposition, θ is a discrete angle and $\tau_n(\theta)$ is the mapped time-difference of arrivals between the microphone or other audio input n and the first microphone or other audio input for a particular discrete angular direction, given the microphone or other audio input geometry and sound speed. The spatial coherence is buffered in a buffer of size $L_{max}$ and the most dominant DOA at the frame 1 is computed as:

$$DOA(l) = \text{argmax}_\theta \sum_{\upsilon=0}^{L_{max}-1} SC(\theta, l - \upsilon) \tag{2}$$

Figure 4:
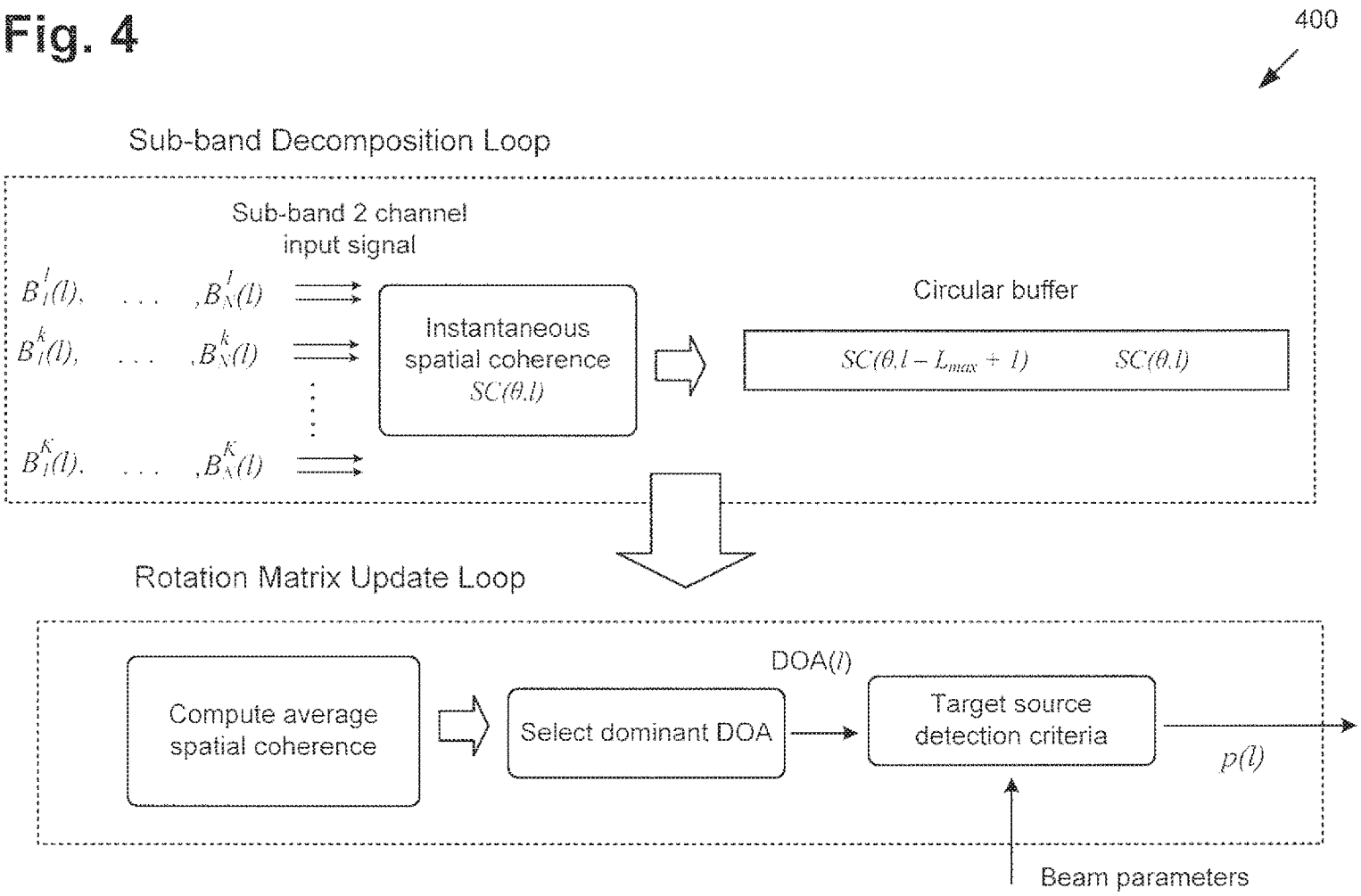
FIG. 4 is a diagram of target detection in accordance with an exemplary implementation of the present disclosure.

FIG. 4 is diagram 400 of target source detection in accordance with an exemplary implementation of the present disclosure. It can be assumed that either the target source or the noise sources dominate a particular frame. Then, a binary probability of target source presence can be defined as:

$$p(l)=1, |\text{DOA}(l)-\text{Beam}_u| \leq \text{Beam}_w \tag{3}$$

$$p(l)=0, \text{otherwise} \tag{4}$$

where $\text{Beam}_u$ and $\text{Beam}_w$ are the beam center and width respectively.

Figure 5:
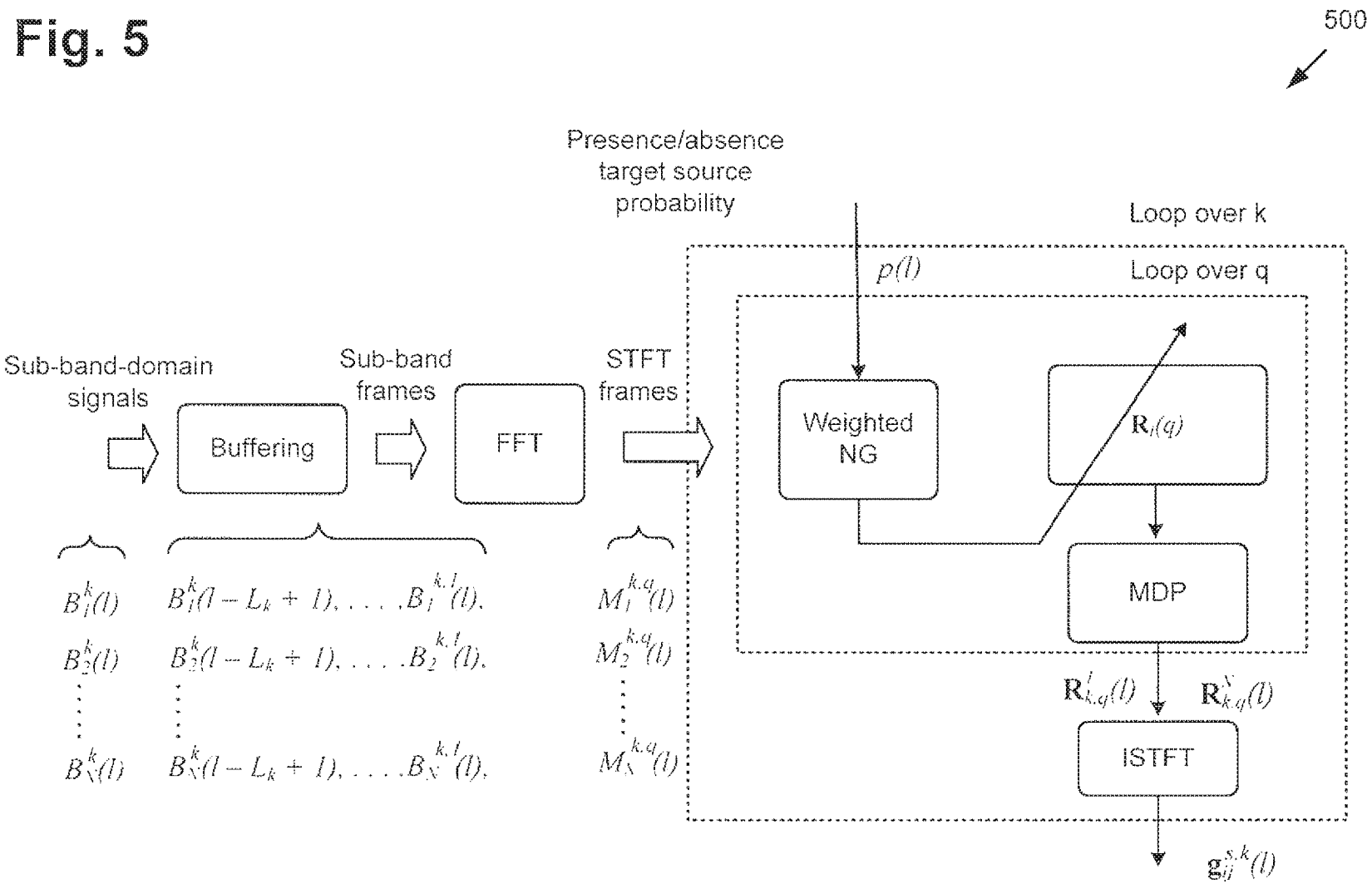
FIG. 5 is a diagram of spatial filter estimation in accordance with an exemplary implementation of the present disclosure.

FIG. 5 is diagram 500 depicting spatial filter estimation in accordance with an exemplary implementation of the present disclosure. To update the spatial rotation matrix, a weighted scaled Natural Gradient is adopted using an online update rule. For each sub-band k we transform the $L_k$ buffered frames into a higher frequency domain resolution through fast Fourier transform (FFT) as $$M_i^{k,q}(l)=\text{FFT}[B_i^k(l-L_k+1), \ldots, B_i^k(l)], \forall_i \tag{5}$$

where q indicates the frequency bin obtained by the Fourier transformation performed using a discrete Fourier transform (DFT) and $L_k$ is the filter length set for the sub-band k. For each sub-band k and frequency bin q, starting from the current initial N×N demixing matrix $R_{k,q}$ (l), we calculate $$\begin{bmatrix} y_1^{k,q}(l) \\ \cdots \\ y_N^{k,q}(l) \end{bmatrix} = R_{k,q}(l) \begin{bmatrix} M_1^{k,q}(l) \\ \cdots \\ M_N^{k,q}(l) \end{bmatrix} \tag{6}$$

Let $z_i^{k,q}(l)$ be the normalized $y_i^{k,q}$ (l) calculate as $$z_i^{k,q}(l)=y_i^{k,q}(l)/|y_i^{k,q}(l)| \tag{7}$$

and let $y_i^{k,q}(l)'$ be the conjugate of $y_i^{k,q}$ (l). Then, we form a generalized covariant matrix as $$C_{k,q}(l) = \begin{bmatrix} z_1^{k,q}(l) \\ \cdots \\ z_N^{k,q}(l) \end{bmatrix} \begin{bmatrix} y_1^{k,q}(l)' & \ldots & y_N^{k,q}(l)' \end{bmatrix} \tag{8}$$

A normalizing scaling factor for the covariant matrix is computed as $s^{k,q}(l)=1/\|C_{k,q}(l)\|_\infty$. $\|\cdot\|_\infty$ indicates the Chebyshev norm, i.e., the maximum absolute value in the elements of the matrix. Using the target source presence probability P we compute the weighting matrix $$W(l) = \begin{bmatrix} \eta p(l) & 0 & 0 & 0 \\ 0 & \eta(1-p(l)) & 0 & 0 \\ 0 & 0 & \ldots & 0 \\ 0 & 0 & 0 & \eta(1-p(l)) \end{bmatrix} \tag{9}$$

where η is a step-size parameter that controls the speed of the adaptation. Then, we compute the matrix $Q_{k,q}$ (l) as $$Q_{k,q}(l)=I-W(l)+s^{k,q}(l)\cdot C_{k,q}(l)W(l) \tag{10}$$

Finally, the rotation matrix is updated as $$R_{k,q}(l+1)=s^{k,q}(l)\cdot Q_{k,q}(l)^{-1}R_{k,q}(l) \tag{11}$$

where $Q_{k,q}(l)^{-1}$ is the inverse matrix of $Q_{k,q}$ (l). Note, the adaptation of the rotation matrix is applied independently in each sub-band and frequency but the order of the output is induced by the weighting matrix, which is the same for the given frame. This has the affect of avoiding the internal permutation problem of standard convolutive frequency-domain ICA. Furthermore, it also fixes the external permutation problem, i.e., the target signal will always correspond to the separated output $y_1^{k,q}$ (l).

Given the estimated rotation matrix $R_{k,q}$ (l) we use the Minimal Distortion Principle (MDP) to remove the scaling ambiguity and compute the multichannel image of target source and noise components. First we indicate the inverse of $R_{k,q}$ (l) as $H_{k,q}$ (l). Then, we indicate with $H_{k,q}^s(l)$ the matrix obtained by setting to zero all of the elements of $H_{k,q}$ (l) except for the s-th column. Finally, the rotation matrix is able to extract the multichannel separated image of the s-th source signal as $$R_{k,q}^s(l)=H_{k,q}^s(l)R_{k,q}(l) \tag{12}$$

Note, because of the structure of the matrix W(l), the matrix $R_{k,q}^1(l)$ is the one that will extract the signal components associated to the target source.

Indicating with $r_{ij}^{s,k,q}$ (l) the generic (i,j)-th element of $R_{k,q}^s$ (l) we define the vector $r_{ij}^{s,k}(l)=[r_{ij}^{s,k,1}(l), \ldots, r_{ij}^{s,k,L_k}(l)]$, and compute the i,j-th filter needed for the estimation of the signal s as $$g_{ij}^{s,k}(l)=\text{circshift}\{\text{IFFT}[r_{ij}^{s,k}(l)], \text{delay}^k\}, \tag{13}$$

$$\text{setting to 0 elements} \leq L_k \text{ AND} \geq (\text{delay}+L_k/2+1), \tag{14}$$

where "delay" is the desired I/O delay defined in the parameters and $\text{circshift}\{\text{IFFT}[r_{ij}^{s,k}(l), \text{delay}^k]\}$ indicates a circular shift (in the right direction) of $\text{delay}^k$ elements defined as if delay>=$L_k/2$
  $delay^k=L_k/2$
else
  $delay^k$=delay
end The estimated power spectral density (PSD) of the source s at the microphone channel i and sub-band k is computed through the filter and sum $$PSD_i^{s,k} = \left|\sum_j g_{ij}^{s,k}(l) * B_j^k(l)\right|^2 \tag{15}$$

where $B_j^k(l)=[B_j^k(l-L_k+1), \ldots, B_j^k(l)]$ indicates the sub-band input buffer related to the j-th channel, and * indicates the convolution. The PSDs are smoothed as $$\overline{PSD}_i^{s,k}(l) = \theta \cdot \overline{PSD}_i^{s,k}(l) + (1-\theta) \cdot PSD_i^{s,k}(l), \text{ if } \left(\overline{PSD}_i^{s,k}(l) > PSD_i^{s,k}(l)\right) \tag{16}$$

$$= PSD_i^{s,k}(l), \text{ otherwise} \tag{17}$$

Where θ is a smoothing parameter.

Figure 6:
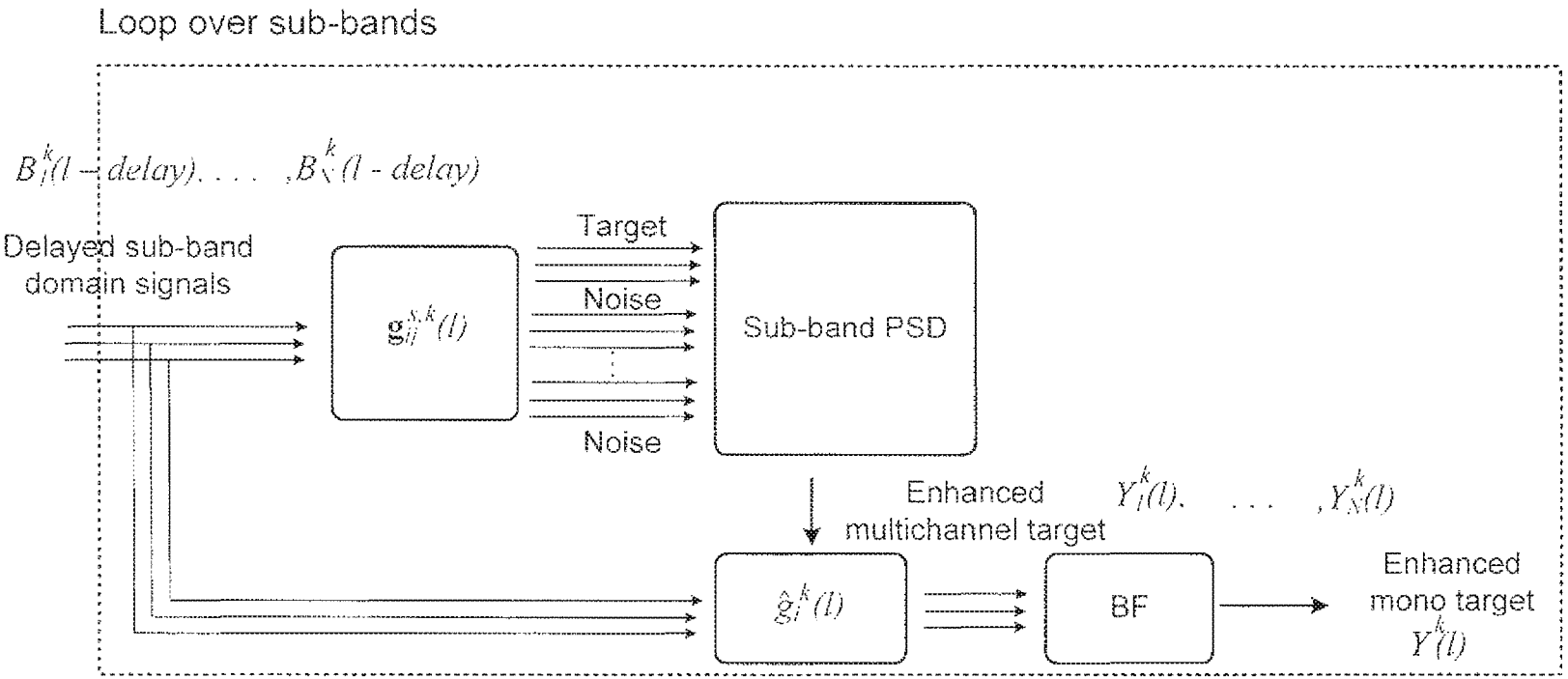
FIG. 6 is a diagram of spectral filtering in accordance with an exemplary implementation of the present disclosure.

FIG. 6 is diagram 600 depicting spectral filtering in accordance with an exemplary implementation of the present disclosure. By using the estimated channel dependent PSDs, spectral gains can be derived according to several criteria. For example a Wiener-like spectral gain at the sub-band k, used to compute the multichannel target output signal, can be computed as:

$$\hat{g}_i^k(l) = \sqrt{\frac{\overline{PSD}_i^{1,k}(l)}{\overline{PSD}_i^{1,k}(l) + \alpha \sum_{s \neq 1} \overline{PSD}_i^{s,k}(l)}} \tag{18}$$

where α is a noise over-estimation factor (>1).

Then, the enhanced multichannel output signals of the target speech is computed as $$Y_i^k(l)=\hat{g}_i^k(l) \cdot B_i^k(l-\text{delay}) \tag{19}$$

Note, here we are assuming that source s=1 is the target source. If the beam forming option is selected, the two outputs are delay and sum beam formed in the direction of the target speaker as $$Y^k(l) = Y_1^k(l) + \sum_{i=2}^{N} e^{j2\pi f_s(k/K)\tau_i[DOA(l)]} Y_i(l)^k \tag{20}$$

where, $f_s$ is the sampling frequency, K is the total number of sub-bands and τ[DOA(l)] is the TDOA associated to the estimated source DOA at the frame l for the target source between the first and i-th microphone or other audio input.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as keyboards or mice, peripherals such as printers and speakers, associated drivers, control cards, power sources, network devices, docking station devices, or other suitable devices operating under control of software systems in conjunction with the processor or other devices), or other suitable software structures. In one exemplary implementation, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Figure 7:
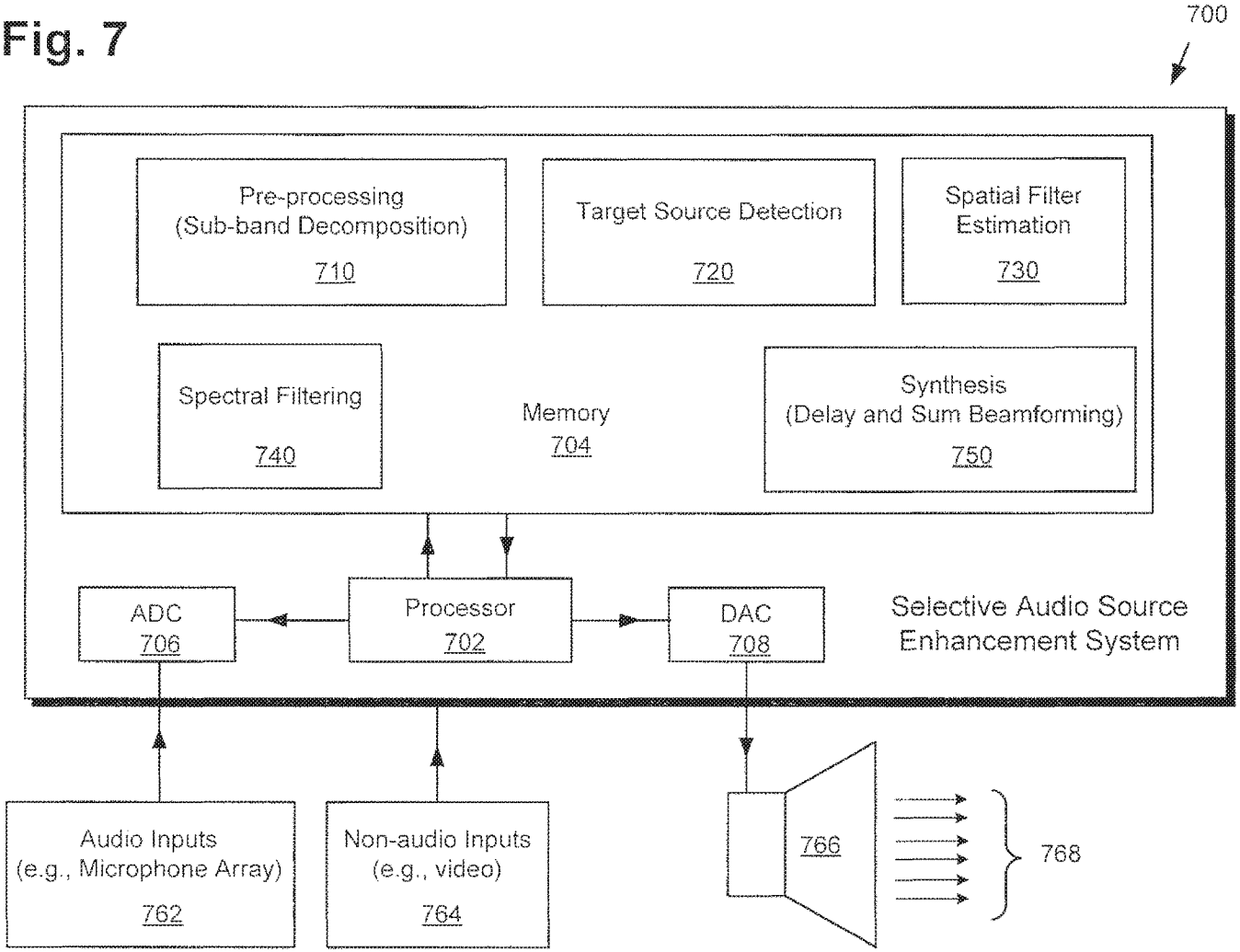
FIG. 7 is a diagram of a selective audio source enhancement system for processing audio data in accordance with an exemplary implementation of the present disclosure.

FIG. 7 is a diagram of a selective audio source enhancement system for processing audio data in accordance with an exemplary implementation of the present disclosure. Selective audio source enhancement system 700 corresponds in general to SSP architecture 100, in FIG. 1, and may share any of the functionality previously attributed to that corresponding system above. Selective audio source enhancement system 700 can be implemented in hardware or as a combination of hardware and software, and can be configured for operation on a digital signal processor or other suitable platform.

As shown in FIG. 7, selective audio source enhancement system 700 includes system processor 702 and system memory 704. In addition, selective audio source enhancement system 700 includes pre-processing unit 710, target source detection unit 720, spatial filter estimation unit 730, spectral filtering unit 740, and synthesis unit 750, some or all of which may be stored in system memory 704. Also shown in FIG. 7 are microphone array 762 or other audio input or inputs 762 to selective audio source enhancement system 700 ADC 706 configured to receive the audio input(s), non-audio input or inputs 764, such as video input(s), and speaker or application 766, which can be an application residing on an electronic or electromechanical system such as a television, a laptop computer, an alarm system, a game console, or an automobile, for example. It is noted that in implementations in which application 766 takes the form of a speaker, as shown in FIG. 7, selective audio enhancement system 700 may also include DAC 708 to provide an analog signal to speaker 766 for emission as selectively enhanced audio signal 768.

Pre-processing unit 710 is controlled by system processor 702 and is configured to perform sub-band domain complex-valued decomposition with a variable length sub-band buffering for a non-uniform filter length in each sub-band. The original frequency-domain approach proposed earlier can be applied in the sub-band domain in order to optimize the processing load and reduce the memory requirement. The basic idea is that shorter filters are required at higher sub-bands because the effect of reverberation is negligible, while longer filters are required at low frequency. This approach provides a good trade-off between memory usage and performance so that the algorithm can provide a good performance with a small amount of memory. Pre-processing unit 710 is configured to receive audio data including a target audio signal, and to perform sub-band domain decomposition of the audio data to generate a plurality of buffered outputs. In one implementation, pre-processing unit 710 is configured to perform decomposition of the audio data as an undersampled complex valued decomposition using variable length sub-band buffering.

Target source detection unit 720 is controlled by system processor 702 and can be utilized to process audio from a source of interest. It is noted that although the audio may be speech or other sounds produced by a human voice, the present concepts apply more generally to substantially any audio source of interests. Each adaptation frame is classified as dominated by target source or noise according to some predefined criteria. As a basic criteria, the dominant source DOA is used but any other voice activity detection (VAD) based on other spatial and spectral features can be nested in this framework. For each adaptation frame, the DOA is estimated and the frame is classified as a target if it lies in a configurable angular region, which is defined as a "target beam." That is to say, target source detection unit 720 is configured to receive the plurality of buffered outputs from pre-processing unit 710, and to generate a target presence probability corresponding to the target audio signal.

Spatial filter estimation 730 unit is controlled by system processor 702 and is configured to receive the target presence probability, and to transform frames buffered in each sub-band into a higher resolution frequency-domain. Spatial filter estimation unit 730 can use buffered frames in each sub-band that are transformed in a higher-resolution frequency domain through FFT. In this domain, linear de-mixing filters for segregating noise from the target source are estimated with a frequency domain weighted natural gradient adaptation independently in each frequency. Different from conventional ICA-based adaptation, which jointly estimates the full de-mixing filters, the disclosed algorithm alternatively estimates the corresponding de-mixing filters of noise and target source according to their dominance in the current frame. This strategy improves the convergence speed of the on-line adaptation and reduces the computational load. As a basic control, a single frame-based binary weight is used in the weighted natural gradient depending on the target/noise dominance for a particular frame. The frame-based binary weighting also removes the permutation problem typically observed in frequency-domain ICA-based source separation algorithms. However, subband-based weights and non-binary weights can be still used within this framework.

Spectral filtering unit 740 can be controlled by system processor 702 to convert the estimated de-mixing matrices in time-domain filters in order to retrieve the multichannel image of the target audio signal and noise signals. Spectral gains based on Wiener minimum mean-square error (MMSE) optimization are derived from the linearly separated outputs and applied to the sub-band input in order to obtain a multichannel image of the target source.

Audio synthesis unit 750 is also controlled by system processor 702 and is configured to extract an enhanced mono signal from the multichannel image. The enhanced mono signal corresponds to the target audio signal. Audio synthesis unit 750 can be configured to implement delay and sum beam forming to enhance the mono signal corresponding to the target audio signal.

There are several advantages to the solution represented by selective audio source enhancement system 700. First, the solution is a general framework that can be adapted to multiple scenarios and customized to the specific hardware limitations of the computing environment in which it is implemented. The present solution has the ability to run with on-line processing while delivering performance comparable to more complex state-of-the-art off-line solutions. The proposed solution also offers "alternate update" structures of the de-mixing filters, which is very effective in improving the convergence speed within the on-line structure. This approach allows fast tracking of target/noise mixing system variations, such as caused by movement of the audio source or audio input(s), and is computationally efficient. For example, it is possible to separate highly reverberated sources even using only two microphones when the microphone-source distance is large. That is to say, in some implementations, selective audio source enhancement system 700 may be configured to selectively recognize a source of the target audio signal that is in motion relative to selective audio source enhancement system 700.

The solution disclosed in the present application differs from traditional beam forming methods which apply hard spatial constraints for the estimation of the filters and may produce distortion in difficult far-field reverberant conditions. The present solution offers a highly flexible structure for updating the filters, capable of including substantially any additional information related to the noise/target detection, thereby enabling the integration of multiple cues for enhancement of a source with a predefined characteristic. Source directionality can still be used in the present solution, in order to focus on a source in a particular spatial region. However, while traditional beam forming methods use the direction as a hard constraint in the filter estimation process, the present solution uses the directionality only as a feature for the target source detection, without imposing any constraint in the actual estimated filters. This allows the estimated filters to fully adapt to the reverberation and, with a proper definition of the VAD, it is also possible to enhance an acoustic source propagating from the same direction as the noise.

The present solution also provides the ability to adapt the total filter length according to available memory using a non-uniform filter length distribution across the sub-bands, the ability to scale the computational load by properly setting the filter adaptation rate, and the ability to efficiently exploit on-line frequency domain ICA without creating the typical permutations known to such solutions.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described herein, but many rearrangements, modifications, and substitutions are possible without departing from the scope of the present disclosure.

What is claimed is:

1. An audio enhancement system comprising:

a pre-processing unit configured to receive a multichannel audio input signal and decompose each channel of the multichannel audio input signal into a series of buffered frequency sub-band signals;

a target source detection unit configured to generate a target presence probability for the buffered frequency sub-band signals, the target presence probability representing a likelihood that the buffered frequency sub-band signals include a target signal from a target source;

a spatial filter estimation unit configured to receive the target presence probability and perform a supervised independent component analysis ("ICA") adaptation for each of the buffered frequency sub-band signals to estimate spatial filters for separating the target signal and noise, wherein the spatial filters for the target signal and the noise are estimated in the same adaptation;

a spatial filtering unit configured to filter each of the buffered frequency sub-band signals using the estimated spatial filters to produce linear estimations of the target signal and the noise;

a spectral filtering unit configured to receive the buffered frequency sub-band signals and the spatially filtered buffered frequency sub-band signals and generate an enhanced target signal for each of the buffered frequency sub-band signals; and a synthesis unit configured to receive each of the enhanced target signals and construct a time-domain audio output signal comprising the enhanced target signals.

2. The audio enhancement system of claim 1 further comprising a plurality of microphones, each of the plurality of microphones configured to sense sound generated from a plurality of audio sources, including the target source and at least one noise source, and generate one channel of the multichannel audio input signal.

3. The audio enhancement system of claim 1 further comprising a buffer structure configured to store the buffered frequency sub-band signals, wherein each frequency sub-band has an associated buffer length corresponding to a length of a corresponding one of the spatial filters.

4. The audio enhancement system of claim 1 wherein the target source detection unit is further configured to:

calculate an instantaneous spatial coherence for a frame of the buffered frequency sub-band signals and store the calculated instantaneous spatial coherence in a spatial coherence buffer;

select a dominant direction of arrival for the frame using the spatial coherence buffer; and determine the target presence probability using the selected dominant direction of arrival and audio beam parameters.

5. The audio enhancement system of claim 1 wherein the spatial filtering estimation unit is further configured to transform each of the buffered frequency sub-band signals into a higher frequency domain resolution using a Fast Fourier Transform ("FFT"), update a spatial rotation matrix using a weighted scaled Natural Gradient and use Minimal Distortion Principle to extract signal components associated with the target signal.

6. The audio enhancement system of claim 1 wherein the spatial filtering unit is further configured to estimate a power spectral density (PSD) of the target signal in each sub-band of the filtered buffered frequency sub-band signals.

7. The audio enhancement system of claim 6 wherein the spectral filtering unit is further configured to use the estimated power spectral density of each channel and sub-band to derive spectral gains to be applied to the buffered frequency sub-band signals.

8. The audio enhancement system of claim 1 wherein the spectral filtering unit is further configured to derive spectral gains based on Wiener minimum mean-square error (MMSE) optimization from the linearly separated outputs and apply the spectral gains to the buffered frequency sub-band input to obtain a multi-channel image of the target signal.

9. The audio enhancement system of claim 1 wherein the spatial filtering estimation unit is further configured to receive the target presence probability, transform frames buffered in each sub-band into a higher resolution frequency domain, and estimate linear demixing filters for segregating the target signal and noise using a frequency domain weighted natural gradient adaptation independently in each frequency.

10. The audio enhancement system of claim 1 wherein the spatial filtering unit estimates corresponding de-mixing filters for the target signal and noise according to their respective dominance in a current frame.

11. The audio enhancement system of claim 1 further comprising an audio synthesis unit configured to extract an enhanced mono signal corresponding to the target audio signal.

12. An audio enhancement method comprising:

decomposing each channel of a multichannel audio input signal into a series of buffered frequency sub-band signals;

generating a target presence probability for the buffered frequency sub-band signals, the target presence probability representing a likelihood that a frame of the buffered frequency sub-band signals includes a target signal;

estimating spatial filters for separating the target signal and noise by performing a supervised independent component analysis ("ICA") adaptation for each of the buffered frequency sub-band signals using the target presence probability, wherein the spatial filters for the target signal and the noise are estimated in the same adaptation;

applying the estimated spatial filters to the buffered frequency sub-band signals to produce a linear estimation of the target signal and the noise;

generating an enhanced target signal for each of the buffered frequency sub-band signals; and constructing an enhanced mono time-domain audio output signal corresponding to the enhanced target signals.

13. The method of claim 12 wherein the generating a target presence probability further comprises:

calculating an instantaneous spatial coherence for a frame of the buffered frequency sub-band signals and storing the calculated instantaneous spatial coherence in a spatial coherence buffer;

selecting a dominant direction of arrival for the frame using the spatial coherence buffer; and determining the target presence probability using the selected dominant direction of arrival and beam parameters.

14. The method of claim 12 wherein the estimating spatial filters further comprises transforming each of the buffered frequency sub-band signals into a higher frequency domain resolution using a Fast Fourier Transform ("FFT"), and extracting signal components associated with the target signal by updating a spatial rotation matrix using a weighted scaled Natural Gradient and Minimal Distortion Principle.

15. The method of claim 12 further comprising estimating a power spectral density (PSD) of the target signal in each sub-band of the filtered buffered frequency sub-band signals.

16. The method of claim 15 further comprising using the estimated power spectral density of each channel and sub-band to derive spectral gains to be applied to the buffered frequency sub-band signals.

17. The method of claim 12 wherein the generating an enhanced target signal further comprises deriving spectral gains based on Wiener minimum mean-square error (MMSE) optimization from the linearly separated outputs and apply the spectral gains to the buffered frequency sub-band input to obtain a multi-channel image of the target source.

18. The method of claim 12 wherein the estimating spatial filters further comprises transforming frames buffered in each sub-band into a higher resolution frequency domain, and using the target presence probability, estimating linear demixing filters for segregating the target signal and noise using a frequency domain weighted natural gradient adaptation independently in each frequency.

19. The method of claim 12 wherein the estimating spatial filters further comprises estimating corresponding de-mixing filters for the target signal and noise according to their respective dominance in a current frame.

* * * * *